United States Patent [19]

Herrington

[11] Patent Number: 4,787,754

[45] Date of Patent: Nov. 29, 1988

[54] RECLOSABLE FLEXIBLE BAGS HAVING FASTENER PROFILES ATTACHED TO EXTERIOR WALLS THEREOF AND A METHOD OF MAKING SAME

[75] Inventor: Fox J. Herrington, Holcomb, N.Y.

[73] Assignee: Mobil Oil Corporation, New York, N.Y.

[21] Appl. No.: 165,450

[22] Filed: Mar. 1, 1988

Related U.S. Application Data

[63] Continuation of Ser. No. 000,019, Jan. 2, 1987, abandoned.

[51] Int. Cl.[4] ..... B65D 33/16

[52] U.S. Cl. ..... 383/63; 383/94; 156/66; 24/587

[58] Field of Search ..... 383/63, 94, 97; 493/214; 156/66; 24/587

[56] References Cited

U.S. PATENT DOCUMENTS

| | | | |
|---|---|---|---|
| Re. 28,969 | 9/1976 | Naito | 24/201 C |
| 3,226,787 | 1/1966 | Ausnit | 24/201 |
| 3,746,215 | 7/1973 | Ausnit et al. | 383/63 |
| 4,212,337 | 7/1980 | Kamp | 24/201 C |
| 4,392,897 | 7/1983 | Herrington | 156/66 |
| 4,419,159 | 12/1983 | Herrington | 156/66 |
| 4,428,788 | 1/1984 | Kamp | 383/63 |
| 4,561,109 | 12/1985 | Herrington | 383/65 |
| 4,618,383 | 10/1986 | Herrington | 156/66 |

FOREIGN PATENT DOCUMENTS

| | | | |
|---|---|---|---|
| 1435827 | 11/1968 | Fed. Rep. of Germany | 383/63 |
| 551216 | 11/1956 | Italy | 383/63 |
| 0097451 | 2/1961 | Norway | 383/63 |

*Primary Examiner*—Willis Little

*Attorney, Agent, or Firm*—Alexander J. McKillop; Michael G. Gilman; Charles J. Speciale

[57] ABSTRACT

This invention provides a reclosable flexible bag having a tape of greater thickness around its opening portion. On the surfaces of the tape facing the bag, fastener profiles are provided to seal the bag by pinching the bag walls therebetween.

13 Claims, 1 Drawing Sheet

RECLOSABLE FLEXIBLE BAGS HAVING FASTENER PROFILES ATTACHED TO EXTERIOR WALLS THEREOF AND A METHOD OF MAKING SAME

This is a continuation of copending application Ser. No. 000,019, filed on Jan. 2, 1987, now abandoned.

BACKGROUND OF THE INVENTION

1. Field of the Invention

This invention relates to a reclosable flexible bag formed of a thermoplastic film material. More specifically, this invention relates to a reclosable flexible bag having fastener profiles attached to the exterior walls of the bag.

2. Description of the Prior Art

Various closure arrangements have been proposed for closing plastic bags. For example, U.S. Pat. No. Re. 28,969 to Nito shows the initial Zip-lock storage bag in which a profile extrusion on one side of the bag mates with a profile extrusion on the other side of the bag to form an interlocking, reclosable closure. The interlocking profiles of this closure are integral with the plastic film of the bag.

U.S. Pat. No. 3,226,787 to Ausnit shows an apparatus for extruding the interlocking profiles during the fabrication of the plastic sheet.

U.S. Pat. No. 4,212,337 to Kamp shows a closure device made from a heat sealable material. The closure is attached to the heat sealable film in a separate step after the manufacture of the film. Heat is transferred through the film to produce melting at the interface of the film and the closure device to attach the closure to the film. This type of attachment is a slow process which cannot be practically performed in line with extrusion and bag making.

Recently, it has been proposed that the interlocking profiles be placed outside the bag so that upon closing, the bag walls are interposed between the profiles. The advantage of placing the interlocking profiles outside the bag is that the contents of the bag can come in contact only with the film and not the profiles. This provides a cleaner seal. In addition, a more reliable leak proof seal may be obtained since the two layers of film at the side seams are attached together directly and do not extend beyond the interlocking profiles.

The manner by which the interlocking profiles are attached to the exterior of the bag walls has also been investigated. Accordingly, it has been proposed to affix the profiles directly to the exterior surface the bag walls, with the interlocking parts of the profiles facing each other. This has the disadvantage in that one of the bag films is sealed across the two arm portions of the female interlocking profile. Upon repeated use, this portion of the film may be stretched severely so as to cause rupture. It has also been proposed to attach the interlocking profiles only at the end, i.e. the side seams of the bag. However, such "free" profiles become poorly guided and may be shifted off the top of the bag when the bag is being closed. It has further been proposed to affix the raised portion of the profiles to the exterior walls near the mouth portion of the bag. Thereafter, the walls are folded so as to form a cuff surrounding the mouth of the bag. Although such an arrangement reduces the "wandering" of the profiles, aligning the profiles becomes difficult because of the presence of the cuff and the thin bag film.

The present invention overcomes the above described disadvantages associated with previously known reclosable bag structures.

SUMMARY OF THE INVENTION

The present invention provides a reclosable flexible bag comprising:

a pouch having front and back walls and a pouch opening at the upper edge thereof;

a first fastener profile comprising a first tape having first and second edges and a protrusion disposed along the first edge and extending from the surface of the tape;

a second fastener profile comprising a second tape having first and second edges and a substantially C-shaped member disposed along the first edge and extending from the surface of the tape;

the second edges of the first and second tapes being affixed to the exterior of the walls of the pouch and parallel to the pouch opening so that upon closing, the protrusion and C-shaped members interlock, with the front and back walls being interposed therebetween.

This invention also provides a method of manufacturing a plurality of reclosable flexible bags comprising:

advancing a double web of thermoplastic film material having a first wall and a second wall;

advancing a first fastener profile into proximity with the top portion of the exterior of the first wall, the first fastener profile comprising a first tape having first and second edges and a protrusion disposed along the first edge and extending from the surface thereof;

advancing a second fastener profile into proximity with the top portion of the exterior of the second wall, the second fastener profile comprising a second tape having first and second edges and a substantially C-shaped member disposed along the first edge and extending from the surface thereof;

affixing the second edges of the first and second tapes to the upper edge of the double web so that when the fastener profiles interlock, the first and second walls are interposed therebetween; and sealing transversely across the web at intervals to form a plurality of interconnected bags.

DESCRIPTION OF THE PREFERRED EMBODIMENT

According to the present invention, each of the fastener profiles is disposed near an edge of a tape made of a thermoplastic material. The tapes are affixed to the exterior wall and near the opening of a bag formed of a thermoplastic film. The fastener profiles face each other so that when they interlock, the walls of the bag are interposed therebetween. The profiles, bag and tapes are formed of the same thermoplastic material to permit sealing by heat. In addition, the tapes have a thickness which is greater than that of the bag walls. Thus, there is provided a reclosable flexible bag having better appearance, a stiffer opening and easier sealing effort which would lead to wider consumer acceptance.

Figure 1:
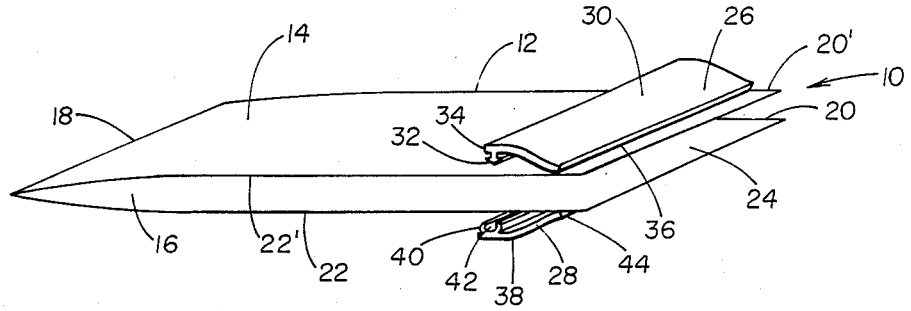
FIG. 1 shows a cross-sectional view of the bag of the present invention.

With reference to FIG. 1 of the drawing bag 10 of the present invention comprises a front wall 14 and a back wall 16, the walls being joined by a seal 18 along the bottom edge. However, it should be understood that front wall 14 and back wall 16 can be made from a single thermoplastic film which has been folded along bottom edge 18 to form the pouch. Parallel to opening 24 and affixed to the top portion of front wall 14 and back wall 16 are fastener profiles 26 and 28, respectively.

Fastener profile 26 comprises tape portion 30 and protrusion 32 affixed near edge 34 of tape 30. The other edge, 36, of tape 30 is affixed to front wall 14. Similarly, fastener profile 28 also comprises a tape 38 and a substantially C-shaped member disposed near edge 42 of tape 38. The other edge, 44, of tape 38 is affixed to the exterior of back wall 16. It is necessary to align the positions of tapes 30 and 38 so that protrusion 32 can be fitted into C-shaped portion 40, with walls 14 and 16 interposed therebetween.

Tapes 30 and 38 have a thickness which is greater than that of front and back walls 14, 16. For example, tapes 30 and 38 may each have a thickness of $3\times10^{-3}$ inch (0.076 mm), walls 15 and 16 may each have a thickness of $1\times10^{-3}$ inch (0.025 mm). By using the tape having a greater thickness than the wall, the opening to the pouch can be stabilized to allow easier handling. Moreover, the thicker tape eliminates sliding or misguidance of the fastener profiles so that bag 10 can be closed and opened easily.

Walls 14, 16 and fastener profile 26 and 28 should be made of the same thermoplastic material so that they can be sealed together. For example, polyethylene or polypropylene can be used. Typically fastener profiles 26 and 28 may be affixed to front wall 14 and back wall 16, respectively, by heat sealing or any conventional means. Fastener profiles 26, 28 may be formed integrally or protrusion 34 and C-shaped portion 40 may be formed first and then affixed to tapes 30 and 38, respectively.

The configurations for protrusion 32 and C-shaped portion 40 can be varied to suit the particular application. Since in the present bag, front wall 14 and back wall 16 are interposed between fastening profiles 26 and 28 when the bag is closed, a more reliable leak proof seal can be obtained.

Figure 2A:
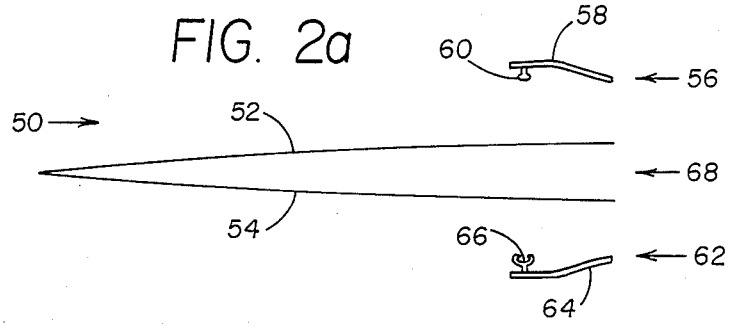
FIGS. 2*a* and 2*b* show in cross-sectional view the positions of the components during the formation of the present bag.
Figure 2B:
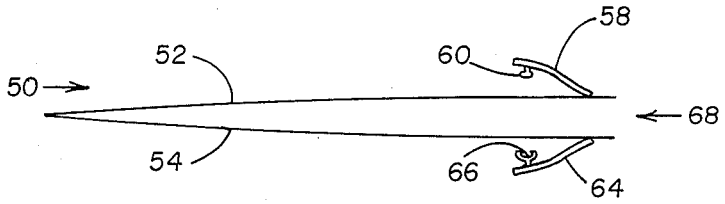

FIGS. *2a* and *2b* show the formation of the present bag. As shown in FIG. 2a, a double web 50 of thermoplastic film material having a front wall 52 and a back wall 54 is prepared. A male fastener profile 56 comprising a tape 58 and a protrusion 60 located near an edge and extending from the surface of the tape and a female fastener profile 62 comprising a tape 64 and a substantially C-shaped member 66 located near an edge and extending from the surface of the tape are provided near the open portion 68 of web 50. Tapes 58 and 64 have a thickness greater than that of walls 52 and 54 to form a stiffer band around the bag's opening The profiles, bag and tapes should be made of the same thermoplastic material to allow sealing by heat and pressure. The fastener profiles are so positioned that the protrusion 60 and C-shaped member 66 face each other, although they are separated by the walls 52 and 54. The profiles are aligned so that after formation of the bag, protrusion 60 will interconnect with C-shaped member 66 when the profiles are pressed together.

Both profiles 56 and 62 are brought into contact with the open portion 68 of web 50. The profiles are caused to become affixed to walls 52 and 54 near the open portion 68, as shown in FIG. *2b*. Profiles 56 and 62 may be affixed to the walls 52 and 54 simultaneously or in sequence. The affixation of the profiles to the web walls is most conveniently conducted by heat sealing. However, any convenient method can be used. Thereafter, transverse seals are made across the web at intervals to form a plurality of interconnected bags. Thereafter, the web is severed to form a stack of individual bags. The sealing and severing may be combined into one step so as to form a plurality of individual bags.

What is claimed is:

1. A reclosable flexible bag comprising:

a pouch having front and back walls and a pouch opening at the upper edge thereof;

a first fastener profile comprising a first tape having first and second edges and a protrusion disposed along the first edge and extending from the surface of the tape;

a second fastener profile comprising a second tape having first and second edges and a substantially C-shaped member disposed along the first edge and extending from the surface of the tape;

the second edges of the first and second tapes being affixed to the exterior of the walls of the pouch and parallel to the pouch opening so that upon closing, the protrusion and C-shaped members interlock, with the front and back walls being interposed therebetween.

2. The bag of claim 1 wherein the first and second tapes have a thickness greater than that of the pouch walls.

3. The bag of claim 1 wherein the first and second fastener profiles are integrally formed.

4. The bag of claim 1 wherein the fastener profiles and the pouch walls are formed of the same thermoplastic material.

5. The bag of claim 4 wherein the material is polyethylene or polyproplylene.

6. A method of manufacturing a plurality of reclosable flexible bags comprising:

advancing a double web of thermoplastic film material having a first wall and a second wall;

advancing a first fastener profile into proximity with the top portion of the exterior of the first wall, the first fastener profile comprising a first tape having first and second edges and a protrusion disposed along the first edge and extending from the surface thereof;

advancing a second fastener profile into proximity with the top portion of the exterior of the second wall, the second fastener profile comprising a second tape having first and second edges and a substantially C-shaped member disposed along the first edge and extending from the surface thereof;

affixing the second edges of the first and second tapes to the upper edge of the double web so that when the fastener profiles interlock, the first and second walls are interposed therebetween;

sealing transversely across the web at intervals to form a pluraltiy of interconnected bags.

7. The method of claim 6 wherein the interconnected bags are severed to form a plurality of individual bags.

8. The method of claim 6 wherein the thermoplastic film material is in the form of a tube severed to form two double webs.

9. The method of claim 6 wherein the thermoplastic film material is folded along the longitudinal axis thereof to form the double web.

10. The method of claim 6 wherein the film material and the first and second fastener profiles are formed of the same thermoplastic material.

11. The method of claim 10 wherein the thermoplastic material is polyethylene or polypropylene.

12. The method of claim 6 wherein the first and second tapes have a thickness greater than that of the web.

13. The method of claim 6 werein the affixing is conducted by heat.

* * * * *